US006307583B1

(12) United States Patent
Randolph et al.

(10) Patent No.: US 6,307,583 B1
(45) Date of Patent: Oct. 23, 2001

(54) THERMAL PRINTER WITH REVERSIBLE RIBBON AND METHOD THEREFOR

(75) Inventors: Craig R. Randolph, Joliet; James A. Thompson, Downers Grove, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/388,100

(22) Filed: Sep. 1, 1999

(51) Int. Cl.[7] ..... B41J 33/24; B41J 33/26; B41J 33/52; B41J 33/00

(52) U.S. Cl. ..... 347/217; 400/235; 400/235.1; 400/234

(58) Field of Search ..... 347/217; 400/218, 400/219, 235, 235.1, 234

(56) References Cited

U.S. PATENT DOCUMENTS

| | | |
|---|---|---|
| 4,675,698 | 6/1987 | Tsutsumi . |
| 4,712,113 | 12/1987 | Brooks et al. . |
| 5,181,788 | 1/1993 | Norman, Jr. et al. . |
| 5,533,819 | 7/1996 | Watanabe et al. . |
| 5,700,096 | 12/1997 | Satoh et al. . |
| 5,795,084 | 8/1998 | Stone . |
| 5,857,786 | 1/1999 | Randolph . |
| 5,906,444 | 5/1999 | Jorgensen . |
| 5,993,092 | 11/1999 | Palmer . |

FOREIGN PATENT DOCUMENTS

| | | | |
|---|---|---|---|
| 0 734 876 A3 | | 10/1996 | (EP) . |
| 2 289 444 A | | 11/1995 | (GB) . |
| PCT/GB96/ 00875 | | 4/1996 | (GB) . |
| 60-63187 | * | 4/1985 | (JP) ..... 400/235.1 |

* cited by examiner

*Primary Examiner*—Huan Tran
(74) *Attorney, Agent, or Firm*—Lisa M. Soltis; Mark W. Croll; Donald J. Breh

(57) ABSTRACT

A thermal printer that transfers print from a ribbon onto a moving web, and methods therefor, by dispensing ribbon from a supply spindle with one or more feed rollers rotating in a first direction, and winding the ribbon on a rewind spindle when dispensing ribbon from the supply spindle when printing. The dispensing direction of the ribbon is reversible before or after printing by rotating the one or more feed rollers in a second direction opposite the first direction to utilize ribbon more efficiently. The reversed ribbon is either rewound on the supply spindle or tensioned with a dancer arm.

22 Claims, 5 Drawing Sheets

THERMAL PRINTER WITH REVERSIBLE RIBBON AND METHOD THEREFOR

BACKGROUND OF THE INVENTION

The invention relates generally to thermal printers, and more particularly to thermal printers having reversible ribbons and methods therefor.

Thermal printers are known generally and used widely, for example to print variable information including lot codes, bar-codes, time and date, and other information on products and packaging, referred to herein as a web or substrate, in coding and marking operations. These printers comprise generally a thermal print head that transfers ink from a carrier, also known as a ribbon, disposed between the web and print head, which may be movable away from the ribbon when not printing. The ribbon is usually advanced, or dispensed, intermittently from a supply spindle to a rewind spindle, for example by an electrically or pneumatically driven feed roller or other known ribbon transfer means.

In some thermal printing operations, printing occurs while the web moves relative to the thermal printer, and thus it is necessary for the ribbon to move generally at the same speed as the web during ink transfer. A short time interval however is required to accelerate the ribbon from a stand-still to the web speed prior to printing. This time interval, or delay, depends generally on the speed of the web and also on the capacity of the ribbon transfer means, and results in only partial usage of the ribbon. More particularly, dispensed ribbon advanced beyond the print head while the ribbon accelerates up to the web speed prior to printing is unused, and thus wasted. Moreover, increased web speeds, which improve productivity, cause even greater ribbon waste since more time is required for the ribbon to accelerate up to the web speed. The ribbon is a costly consumable in coding and marking operations, and therefore it is desirable to utilize ribbon as efficiently as possible.

The present invention is drawn toward advancements in thermal printers.

An object of the invention is to provide novel thermal printers and methods therefor that overcome problems in the art.

Another object of the invention is to provide novel thermal printers and methods therefor that are reliable and economical.

Another object of the invention is to provide novel thermal printers and methods therefor that use ribbon more efficiently.

Another object of the invention is to provide novel thermal printers and methods therefor capable of reversing the direction that the ribbon is fed or dispensed.

A further object of the invention is to provide novel thermal printers and methods therefor that are operated electrically without the need for a compressed air supply.

Yet another object of the invention is to provide novel thermal printers and methods therefor that operate reliably in greasy printing environmental conditions.

A more particular object of the invention is to provide novel thermal printers that transfer print from a ribbon onto a moving web and methods therefor comprising generally dispensing the ribbon from a supply spindle with a feed roller rotating in a first direction, winding the ribbon on a rewind spindle when dispensing ribbon from the supply spindle, and reversing the ribbon dispensing direction before or after printing by rotating the feed roller in a second direction opposite the first direction to rewind unused ribbon.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

The thermal printers of the present invention comprise generally a supply spindle for dispensing ribbon therefrom, a rewind spindle for winding ribbon dispensed from the supply spindle, and a feed roller coupled to a bi-directional motor that rotatably drives the feed roller in first and second opposing directions. The ribbon is disposed at least partially about and frictionally engaged with the feed roller, which is rotatable to feed, or dispense, ribbon in first and second reversible directions. The ribbon is fed between the web and a thermal print head, which in some embodiments may be positioned away from the ribbon when not printing on the web.

When printing on a moving web, generally, the feed roller rotates in a first direction that dispenses ribbon from the supply spindle. As ribbon is dispensed from the supply spindle, ribbon is also wound about the rewind spindle. After printing on the web, the ribbon feed direction is reversed by rotating the feed roller in a second direction opposite the first direction. In other words, the ribbon is backed-up slightly by reversing its feed direction before or after each printing operation to eliminate or substantially reduce the amount of unused ribbon that is advanced past the print head, when the ribbon was accelerated up to the substrate speed, thereby eliminating or at least substantially reducing ribbon waste.

In one embodiment, generally, the ribbon is rewound on the supply spindle when its feed direction is reversed. In an alternative embodiment, however, ribbon slack is taken up by a pivotal dancer arm without rewinding ribbon on the supply spindle. The amount of ribbon that is backed-up, and in some embodiments rewound on the supply spindle, by reversing the feed wheel direction depends generally on the amount of ribbon that advances past the print head while accelerating the ribbon up to the same speed as the substrate. Ribbon usage and feed rates are measured accurately with an encoder, as is known generally.

Figure 1:
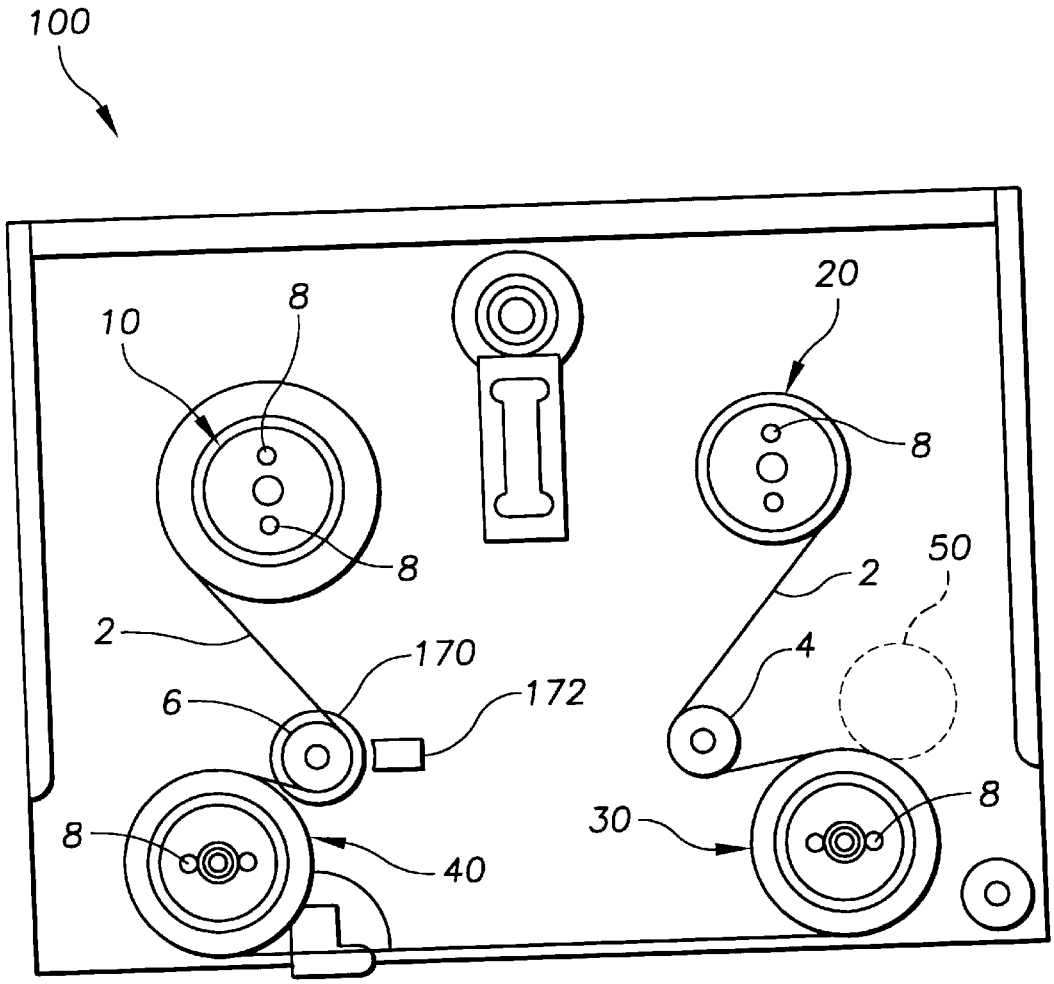
FIG. 1 is a thermal printer ribbon cassette according to an exemplary embodiment of the invention.

In the exemplary embodiment of FIG. 1, the thermal printer comprises generally a supply spindle 10 for dispensing ribbon 2 therefrom, a rewind spindle 20 for winding ribbon dispensed from the supply spindle, and a first feed roller 30. The ribbon 2 dispensed from the supply spindle 10 and wound about the rewind spindle 20 may be wound about corresponding plastic or cardboard cores, not shown in the drawings, disposed and retained frictionally about the supply and rewind spindles, as is known generally.

In FIG. 1, the ribbon 2 is disposed at least partially about and frictionally engaged with the first feed roller 30, which is coupled to a bi-directional motor that rotates the feed roller 30 in first and second opposing directions to dispense ribbon from and wind ribbon on the supply spindle 10, as discussed more fully below. The ribbon 2 is dispensed from the supply spindle 10 to and about an idler roller 4, which is preferably positioned so that the ribbon 2 is wound about a substantial portion of the feed roller 30, and in the exemplary embodiment approximately one-half, or a 180 degree circumferential portion thereof, thereby increasing surface contact therewith to lessen the possibility of slippage of the ribbon 2 relative thereto, which may be troublesome in some operational environments.

Also in FIG. 1, a second feed roller 40 is coupled preferably to the bi-directional motor, and the ribbon 2 is disposed at least partially thereabout and frictionally engaged therewith at least for dispensing the ribbon from the supply spindle, and in some embodiments for reversing the ribbon feed direction, as discussed more fully below. The second feed roller 40 also has associated therewith an idler roller 6 positioned so that the ribbon 2 is wound substantially about the second feed roller 40 to increase surface contact therewith, as discussed above in connection with the first feed roller 30. In alternative embodiments of the invention, however, only one feed roller is required.

A rotary encoder is used generally to measure incremental ribbon travel information, which is used to determine the distance that the ribbon is reversed after the printing operation, thereby minimizing unused portions of the ribbon between printing operations. In the exemplary embodiment of FIG. 1, an encoded disk 170 is disposed about and rotates with the idler roller 6, which is rotated by the ribbon 2 wrapped thereabout. The ribbon 2 preferably has a substantial wrap angle around the idler roller 6 to minimize slippage, thus providing an accurate measure of ribbon travel. A detector 172 is disposed adjacent the disk 170 to measure the rotation thereof, which is input to a controller, not shown but known generally, that controls the bi-directional motor and thus the one or more feed rollers. In alternative embodiments, the encoder disk may be disposed on the one of the feed rollers, or another idler roller. Other known means for measuring ribbon distance travel may be used alternatively.

In some printing environments, for example in greasy manufacturing environments, it is desirable to use both the first and second feed rollers to advance and rewind the ribbon, discussed above, whereas in other embodiments of the invention only one feed roller is sufficient. FIG. 1 also illustrates, in phantom, a pressure roller 50 biased, for example by a spring, to move the ribbon 2 against the feed roller 30 to further increase frictional engagement therewith, as is known generally. The pressure roller 50 may be desirable on one or both of the feed rollers in printer embodiments intended for use in applications where ribbon slippage is problematic.

Figure 2:
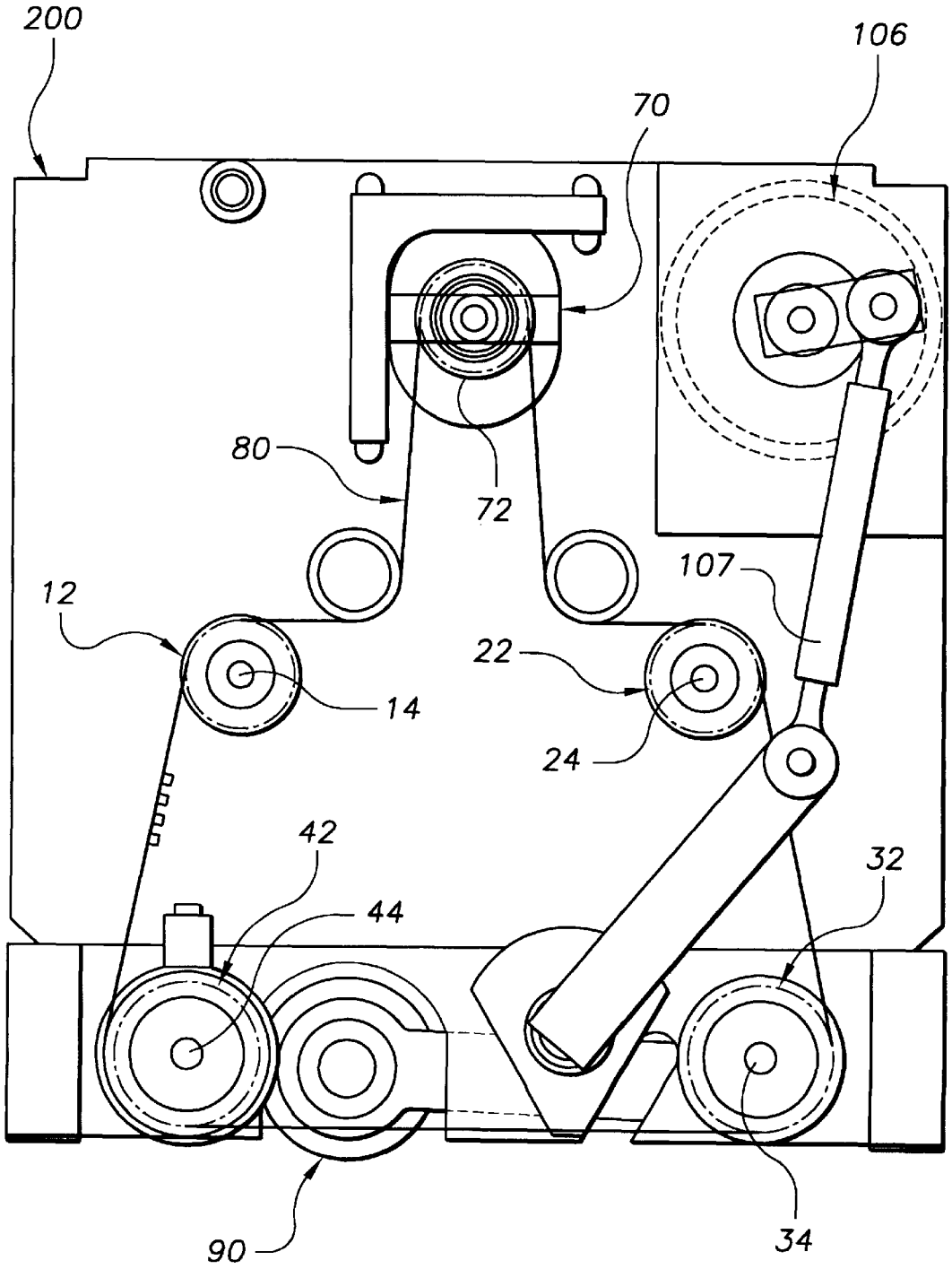
FIG. 2 is a thermal printer print engine for use with the cassette of FIG. 1.

In the first exemplary embodiment, the bi-directional motor is coupled to the supply and rewind spindles 10 and 20 for rotating the supply and rewind spindles in first and second opposing directions along with the one or more feed rollers. FIG. 2 illustrates, more particularly, a bi-directional motor 70, for example an electric stepper motor, having a drive pulley 72 coupled to a drive belt 80, which is coupled to a supply pulley 12, a rewind pulley 22, a feed pulley 32 and alternatively a second feed pulley 42 in embodiments that include a second feed roller. In other embodiments, the bi-directional motor may be an air motor.

The drive belt 80 is preferably a toothed drive belt, or a chain, and the one or more feed pulleys 32 and 42 and the drive pulley 72 are preferably cogged pulleys engageable with the toothed drive belt or chain to ensure a positive, non-slip drive. In the exemplary embodiment, the supply and rewind pulleys 12 and 14 are non-cogged rubber pulleys, or rollers, engageable with the toothed drive belt 80, since non-slipping engagement thereof with the drive belt 80 is not generally required, as discussed further below. The supply spindle 10 is coupled to the supply pulley 12, the rewind spindle 20 is coupled to the rewind pulley 22, the feed roller 30 is coupled to the feed pulley 32, and the second feed roller 40 is coupled to the second feed pulley 42, for example by corresponding drive shafts 14, 24, 34 and 44.

In the first exemplary embodiment, the thermal printer comprises a ribbon cassette 100 illustrated in FIG. 1 removably coupleable to a print engine 200 illustrated in FIG. 2. In FIG. 1, the supply spindle 10, the rewind spindle 20, the feed roller 30 and the second feed roller 40 are rotatably mounted on the ribbon cassette 100. And in FIG. 2, the bi-directional motor 70, the supply pulley 12, the rewind pulley 22, the feed pulley 32, and the second feed pulley 42 are rotatably mounted on the print engine 200. When the ribbon cassette 100 is coupled to the print engine 200, the supply spindle 10 is coupled to the supply pulley 12, the rewind spindle 20 is coupled to the rewind pulley 22, the feed roller 30 is coupled to the feed pulley 32, and the second feed roller 40 is coupled to the second feed pulley 42, by means known generally. The ribbon cassette 100 and print engine 200 also include structure to facilitate the alignment, mounting and fastening thereof, as is known generally.

In FIG. 1, the supply and rewind spindles 10 and 20 and the feed rollers 30 and 40 each include one or more lugs or dogs 8 protruding from an axial end thereof. The dogs 8 are coupled to the corresponding pulleys 12,22,32, and 42 by corresponding recessed drive members that accommodate the dogs when the cassette 100 is coupled to the print engine 200. The recessed drive members, not shown in FIG. 1, are coupled to the corresponding pulleys by the drive shafts associated therewith, as is known generally and discussed further below.

In other embodiments, the thermal printer does not include a removable cassette, and is instead a single assembly. In this alternative non-removable ribbon cassette embodiment, FIG. 1 is interpreted as a front side of the thermal printer and FIG. 2 is interpreted as a back-side of the thermal printer. The supply spindle 10 is coupled directly to the supply pulley 12, the rewind spindle 20 is coupled directly to the rewind pulley 22, the feed roller 30 is coupled directly to the feed pulley 32, and the second feed roller 40 is coupled directly to the second feed pulley 42 by the corresponding drive shafts 14, 24, 34 and 44 extending between the rear and front sides of the printer, without the lugs and slots.

In FIG. 2, the thermal printer further comprises a thermal print head 90 mounted on the print engine 200 for transferring ink from the ribbon onto the web during printing operations. The print head 90 of FIG. 2 is viewed from a back-side of the print engine 200, and is similar to the print head 90 of FIG. 5, which is viewed from a front -side of a print engine according to an alternative embodiment discussed further below. The thermal print head 90 is preferably movable toward and away from the ribbon, and in the exemplary embodiment of FIG. 2 a rotary solenoid 106 mounted on the print engine is coupled to the thermal print head 90 by an actuator linkage 107 for this purpose. Alternatively the solenoid 106 may be a linear solenoid. In operation, the solenoid 106 moves the print head 90 toward the ribbon during printing operations and moves the print head 90 away from the ribbon when not printing.

Figure 3:
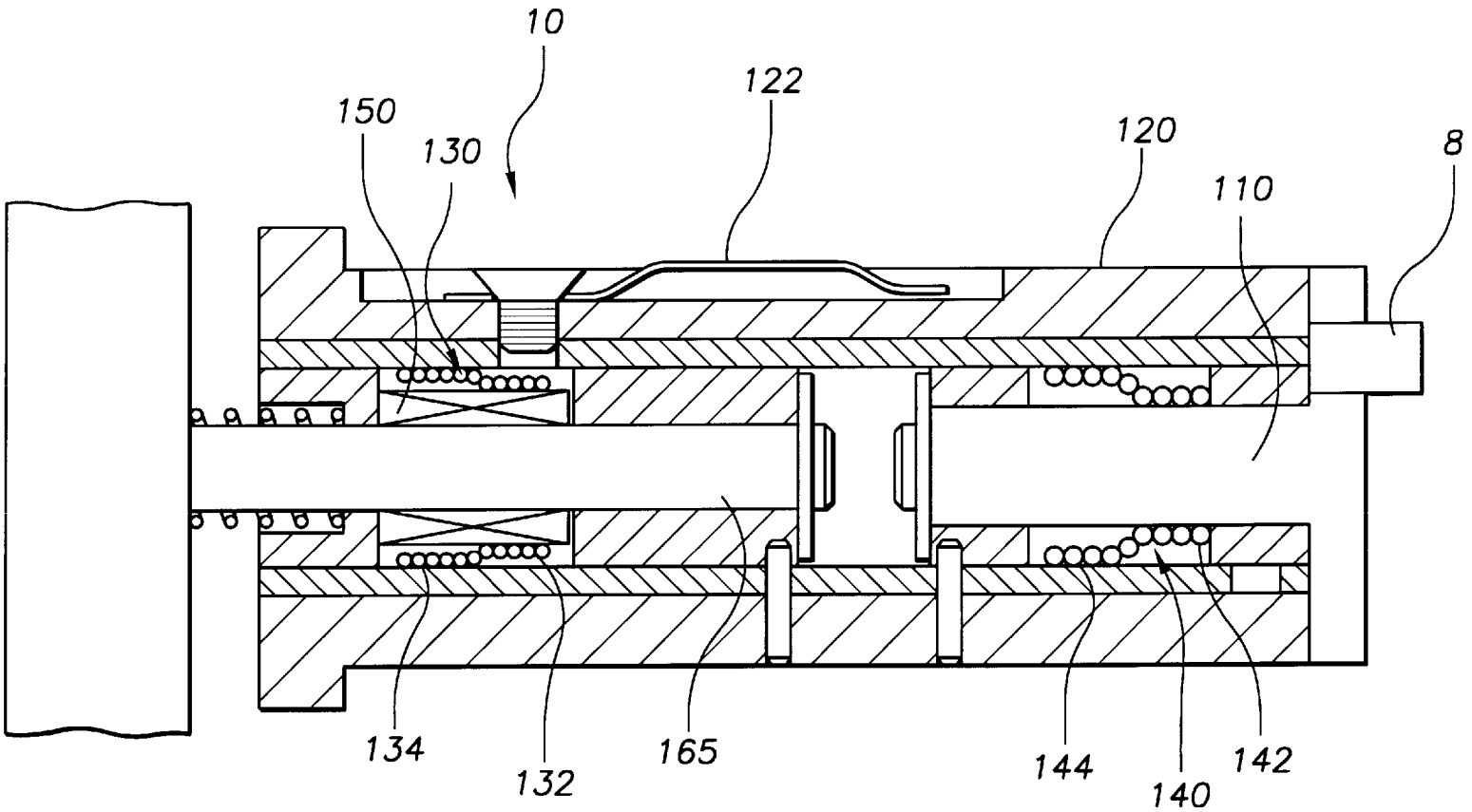
FIG. 3 partial sectional view of an exemplary feed roller.

FIG. 3 is a partial sectional view of a supply spindle 10 configured according to an exemplary embodiment of the invention. The supply spindle 10 has an outer drum 120 disposed generally concentrically about an inner shaft. A slip clutch 140 couples the outer drum 120 to a rotatable inner shaft portion 110 of the inner shaft, which is coupled to the bi-directional motor, and more particularly to the supply pulley as discussed above. The slip clutch 140 controls rotation of the outer drum 120 relative to the inner shaft portion 110 depending upon the relative rotational movement therebetween, as discussed more fully below. In the exemplary embodiment, the outer drum 120 includes a resilient member 122 or other means for frictionally engaging and retaining a ribbon core, not shown, thereabout.

A drag brake 130 couples the outer drum 120 to a fixed inner shaft portion 165 of the inner shaft, wherein the fixed inner shaft portion is aligned axially with the rotatable inner shaft portion. In the exemplary embodiment, the fixed inner shaft portion 165 is coupled to the ribbon cassette 100. The drag brake 130 controls rotation of the outer drum 120 relative to the fixed inner shaft portion 165 depending upon the relative rotational movement therebetween, as discussed more fully below.

The drive belt 80 rotates the supply and rewind spindles 10 and 20 and the one or more feed wheels 30 and 40 in one of the first and second opposing directions, depending on the rotational direction of the bi-directional motor. The rotational speed of the supply and rewind spindles, however, are generally different than the rotational speed of the feed wheel, which is constant, or fixed. More particularly, the rotational speed of the supply and rewind spindles 10 and 20 varies depending on the diameter of the ribbon wound thereabout. Generally, the diameter of the ribbon on the supply spindle decreases and the diameter of the ribbon on the rewind spindle increases during operation of the printer, although the ribbon diameter of the supply spindle may temporarily increase slightly when the ribbon feed direction is reversed and ribbon is wound thereabout, as discussed above.

In the supply spindle 10, the drag brake 130 generally provides a controlled amount of drag on the outer drum 120 about the fixed inner shaft portion 165 as the outer drum 120 rotates in a direction that dispenses ribbon from the supply spindle 10, thereby providing a controlled amount of tension on the ribbon dispensed from the supply spindle. The slip clutch 140 generally allows a controlled amount of slippage of the outer drum 120 relative to the rotatable inner shaft portion 110 when the supply spindle 10 rotates in a direction that winds ribbon thereabout, thereby providing a controlled amount of tension on the ribbon wound about the supply spindle.

In the exemplary embodiment of FIG. 3, the drag brake 130 is a wrap-around spring having a first end portion 132 frictionally engaged with the fixed inner shaft portion 165 and a second end portion 134 frictionally engaged with the outer drum 120 when the outer drum 120 rotates about the fixed inner shaft portion 165 in a direction that dispenses ribbon from the supply spindle 10, thereby providing the controlled amount of frictional drag between the fixed inner shaft portion and the outer drum. The slip clutch 140 is also a wrap-around spring having a first end portion 142 frictionally engaged with the rotatable inner shaft portion 110 and a second end portion 144 frictionally engaged with the outer drum 120 when the outer drum 120 rotates about the inner shaft portion 110 in a direction that winds ribbon on the supply spindle 10, thereby providing the controlled amount of frictional slippage between the rotatable inner shaft portion and the outer drum.

Alternatively, the drag brake and slip clutch may comprise corresponding torsional springs instead of wrap-around springs. The torsional springs each have generally an end portion coupled to the outer drum, whereby a portion of the torsional spring is wound between the corresponding fixed or rotatable inner shaft portions and outer drum in a direction that engages the inner shaft to provide the desired drag or slippage therebetween, depending on the rotational direction of the outer drum.

In FIG. 3, the supply spindle 10 preferably includes a one-way clutch 150 coupling the drag brake 130 to the fixed inner shaft portion 165. The one-way clutch 150 operates to disengage the drag brake 130 when the outer drum 120 rotates about the fixed inner shaft portion 165 in a direction that winds ribbon on the supply spindle 10. The one-way clutch 150 thus eliminates any drag created by the drag brake 130 when the outer drum 120 rotates in a direction that winds ribbon about the supply spindle. The one-way clutch 150 also reduces the load on the bi-directional motor thus permitting use of a smaller, less costly motor.

The rewind spindle 20 is configured and operates generally the same as the supply spindle 10, as illustrated in FIG. 3 and discussed above. More particularly, the drag brake of the rewind spindle generally provides a controlled amount of drag on the outer drum thereof when the rewind spindle rotates in a direction that dispenses ribbon therefrom, thereby providing a controlled amount of tension on the ribbon. The slip clutch of the rewind spindle generally allows the outer drum thereof to slip in a controlled manner relative to the rotatable inner shaft when the rewind spindle rotates in a direction that winds ribbon thereabout, thereby providing a controlled amount of tension on the ribbon. The rewind spindle also preferably includes a one-way clutch that couples the drag brake thereof to the fixed inner shaft for disengaging the drag brake when the outer drum rotates in a direction that winds ribbon on the rewind spindle, as discussed above in connection with the supply spindle.

Figure 4:
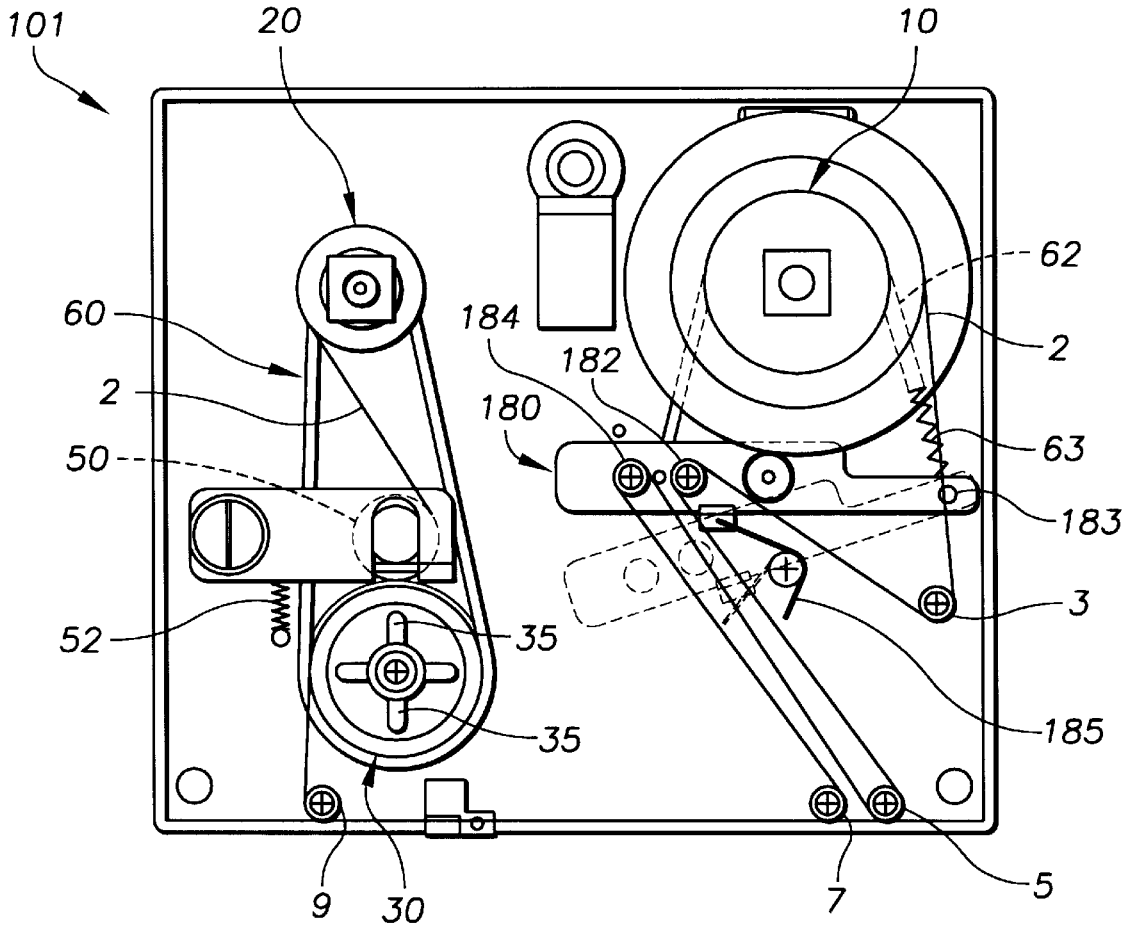
FIG. 4 is a thermal printer ribbon cassette according to an alternative embodiment of the invention.

FIG. 4 is another exemplary embodiment of the thermal printer comprising generally a supply spindle 10 for dispensing ribbon 2 therefrom, a rewind spindle 20 for winding ribbon dispensed from the supply spindle, and a first feed roller 30. The ribbon 2 dispensed from the supply spindle 10 and wound about the rewind spindle 20 may also be disposed generally about corresponding plastic or cardboard cores disposed thereabout, as discussed above.

In FIG. 4, the ribbon 2 is dispensed from the supply spindle 10 to and about an idler roller 3 and then about at least one dancer roller 182 of a dancer arm 180 biased by a spring member 185 to pivot about a pivot 183. In the exemplary embodiment, the ribbon 2 is also disposed about a second idler roller 5, about a second dancer roller 184 of the dancer arm 180, and then about a third idler roller 7. The dancer arm 180 is pivotal about the pivot 183 to control slack, and more particularly to maintain tension, in the ribbon 2, during operation of the thermal printer, as discussed further below.

In FIG. 4, the ribbon 2 is fed from the third idler roller 7 to a fourth idler roller 9 and then at least partially about the feed wheel 30 where it is engaged frictionally with the assistance of a pressure roller 50 biased into engagement with the feed roller 30 by a spring member 52. The feed roller 30 of FIG. 4 may be configured alternatively without the pressure roller 50, for example with one or more additional idler rollers that dispose the ribbon about a substantial portion of the feed roller 30 as in the embodiment of FIG. 1.

In FIG. 4, the feed roller 30 is coupled to the rewind spindle 20 by a drive belt 60, which rotates the rewind spindle 20 in the same direction that the feed wheel 30 is driven by the bi-directional motor. The drive belt 60 however is capable of slipping relative to the rewind spindle 20 to permit the rewind spindle to vary its speed as the ribbon diameter thereof changes. The ribbon wound about the rewind spindle 20 thus has a controlled amount of tension applied thereto as it slips relative to the drive belt 60.

Also in FIG. 4, the supply spindle 10 has coupled thereto a drag brake that provides a controlled amount of drag on the supply spindle 10 as ribbon is dispensed therefrom, thereby maintaining a controlled amount of tension on the ribbon dispensed from the supply spindle. The drag brake in FIG. 4 is a resilient belt 62 disposed about and frictionally engageable with the supply spindle 10. The resilient belt 62 includes a spring member 63 connected thereto for providing resiliency. The drag applied by the resilient belt 62 on the supply spindle 10 varies with the generally decreasing diameter of the ribbon thereon, and depends generally on the pivotal position of the dancer arm 180 to which opposing ends of the resilient belt are connected, as is known generally. Alternatively, the drag on the supply spindle 10 may be provided by other known drag brakes, including those discussed hereinabove in connection with the embodiment of FIG. 1.

In FIG. 4, the ribbon dispensing direction is reversed by rotating the feed roller 30 and rewind spindle 20 in a direction that dispenses the ribbon 2 from the rewind spindle 20, counter-clockwise in FIG. 4. As the ribbon 2 is dispensed from the rewind spindle 20, the dancer arm 180 is pivoted by the spring member 185 in a direction that takes up slack in the ribbon 2, clockwise in FIG. 4. Thus configured, it is not necessary to rewind ribbon on the supply spindle 10 when dispensing ribbon from the rewind spindle 20, as in the embodiment of FIG. 1, since the dancer arm 180 maintains tension on the ribbon 2.

The dancer arm 180 has a limited ability to take compensate for slack in the ribbon 2 in comparison to the reversibly rotatably supply spindle 10 in FIG. 1, which can rewind an unlimited amount of ribbon thereabout. The dancer arm 180 of the embodiment of FIG. 4, however, permits sufficient rewinding of ribbon advanced beyond the print head during acceleration of the ribbon up to the web speed to more completely utilize the ribbon. The amount of slack taken up by the dancer arm 180 depends generally on the extent of the pivotal displacement thereof, and on the number of dancer rollers thereon.

Figure 5:
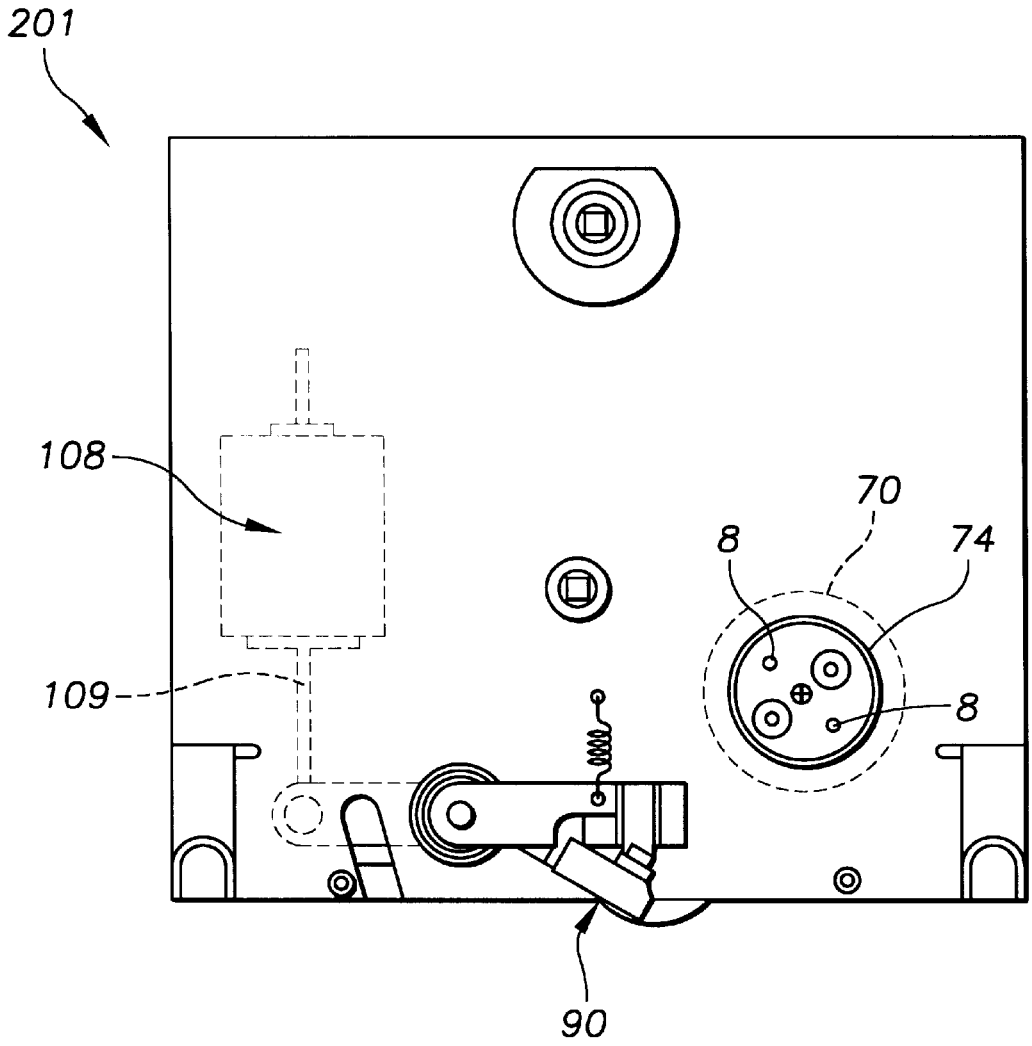
FIG. 5 is a thermal printer print engine for use with the cassette of FIG. 4.

In the second exemplary embodiment, the thermal printer comprises a ribbon cassette 101, illustrated in FIG. 4, removably coupleable to a print engine 201 illustrated in FIG. 5. In FIG. 4, the feed roller 30 is rotatably mounted on the ribbon cassette 101, and the bi-directional motor 70, shown in phantom lines in FIG. 5, is mounted on a back-side of the print engine 201. In FIG. 5, the bi-directional motor 70 is coupled to a drive member 74 on a front side of the print engine 201. The drive member 74 has one or more dogs 8 protruding from an axial end thereof, which are disposed in corresponding recesses 35 on an end of the feed roller 30 as illustrated in FIG. 4 when the ribbon cassette 101 is coupled to the print engine 201. Alternatively, the recesses may be disposed on the drive member, and the dogs may be disposed on the feed roller, as discussed above in connection with the embodiment of FIG. 1. The ribbon cassette 101 and print engine 201 also include structure to facilitate alignment, mounting and fastening thereof, as is known generally.

In FIG. 5, the thermal printer further comprises a thermal print head 90 mounted on the print engine 201 for transferring ink from the ribbon onto the web during printing operations. The thermal print head 90 is preferably movable toward and away from the ribbon, and in the exemplary embodiment of FIG. 5 a linear solenoid 108 mounted on the print engine 201 is coupled to the thermal print head 90 by an actuator linkage 109 for this purpose. Alternatively, the solenoid 108 may be a rotary solenoid. In operation, the solenoid 108 moves the print head 90 toward the ribbon during printing operations and moves the print head 90 away from the ribbon when not printing.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A thermal printer for transferring print from a ribbon onto a web, comprising:

a supply spindle;

a rewind spindle;

the ribbon wound partially about the supply spindle and the rewind spindle;

first and second feed rollers, the ribbon disposed at least partially about and frictionally engaged with the first and second feed rollers;

a bi-directional motor coupled to the first and second feed rollers, the bi-directional motor rotates at least one of the first and second feed rollers in first and second opposing directions, the bi-directional motor further coupled to the supply and rewind spindles for rotating the supply and rewind spindles in first and second opposing directions.

2. A thermal printer for transferring print from a ribbon onto a web, comprising:

a supply spindle;

a rewind spindle;

the ribbon wound partially about the supply spindle and the rewind spindle;

a feed roller, the ribbon disposed at least partially about and frictionally engaged with the feed roller;

a bi-directional motor coupled to the feed roller, the bi-directional motor rotates the feed roller in first and second opposing directions, the bi-directional motor further coupled to the supply and rewind spindles for rotating the supply and rewind spindles in first and second opposing directions, wherein the bi-directional motor is a stepper motor having a drive pulley coupled to a drive belt, the supply spindle coupled to the drive belt by a supply pulley, the rewind spindle coupled to the drive belt by a rewind pulley, and the feed roller coupled to the drive belt by a feed pulley.

3. The thermal printer of claim 2 a ribbon cassette removably coupleable to a print engine having the bi-directional motor mounted thereon, the supply pulley, the rewind pulley, and the feed pulley rotatably mounted on the print engine, the supply spindle, the rewind spindle, and the feed pulley rotatably mounted on the ribbon cassette, the supply spindle coupled to the supply pulley, the rewind spindle coupled to the rewind pulley, and the feed roller coupled to the feed pulley when the print cassette is coupled to the print engine.

4. The thermal printer of claim 3, the drive belt is a toothed drive belt, the drive pulley and the feed pulley are cogged pulleys.

5. The thermal printer of claim 3, thermal print head mounted on the print engine, the thermal print head movable toward and away from the ribbon, a rotary solenoid mounted on the print engine and coupled to the thermal print head, the rotary solenoid actuatable to move the thermal print head toward and away from the ribbon.

6. A thermal printer for transferring print from a ribbon onto a web, comprising:

a supply spindle;

a rewind spindle, the ribbon wound partially about the supply spindle and the rewind spindle;

a feed roller, the ribbon disposed at least partially about and frictionally engaged with the feed roller;

a bi-directional motor coupled to the feed roller, the bi-directional motor rotates the feed roller in first and second opposing directions, the bi-directional motor further coupled to the supply and rewind spindles for rotating the supply and rewind spindles in first and second opposing directions, wherein the supply spindle has an outer drum disposed about an inner shaft, a drag brake couples the outer drum to a fixed portion of the inner shaft and a slip clutch couples the outer drum to a rotatable portion of the inner shaft coupled to the bi-directional motor, the drag brake provides drag on the outer drum when the supply spindle rotates in a direction that dispenses ribbon therefrom, and the slip clutch allows the outer drum to slip relative to the inner shaft when the supply spindle rotates in a direction that winds ribbon thereabout, and wherein the rewind spindle has an outer drum disposed about an inner shaft, a drag brake couples the outer drum to a fixed portion of the inner shaft and a slip clutch couples the outer drum to a rotatable portion of the inner shaft coupled to the bi-directional motor, the slip clutch allows the outer drum to slip relative to the inner shaft when the rewind spindle rotates in a direction that winds ribbon thereabout, and the drag brake provides drag on the outer drum when the rewind spindle rotates in a direction that dispense ribbon therefrom.

7. The thermal printer of claim 6, the supply spindle includes a one-way clutch coupling the drag brake to the inner shaft, the one-way clutch disengages the drag brake when the supply spindle rotates in a direction that winds ribbon thereabout, and the rewind spindle includes a one-way clutch coupling the drag brake to the inner shaft, the one-way clutch disengages the drag brake when the rewind spindle rotates in a direction that winds ribbon thereabout.

8. The thermal printer of claim 6, the drag brake of the supply and rewind spindles are wrap-around springs having a first portion engageable with the inner shafts thereof and a second portion engageable with the outer drums thereof to provide a controlled amount of drag therebetween, and the slip clutches of the supply and rewind spindles are wrap-around springs having a first end portion engagable with the inner shafts thereof and a second portion engageable with the outer drums thereof to provide a controlled amount of slippage therebetween.

9. The thermal printer of claim 6, a second feed roller, the ribbon disposed at least partially about and frictionally engaged with the second feed roller, the bi-directional motor coupled to the second feed roller, a rotary encoder coupled to the ribbon.

10. The thermal printer of claim 9, the bi-directional motor is a stepper motor having a drive pulley coupled to a drive belt, the supply spindle coupled to the drive belt by a supply pulley, the rewind spindle coupled to the drive belt by a rewind pulley, the feed roller coupled to the drive belt by a feed pulley, and the second feed roller coupled to the drive belt by a second feed pulley.

11. The thermal printer of claim 10 a ribbon cassette removably coupleable to a print engine having the bi-directional motor mounted thereon, the supply pulley, the rewind pulley, the feed pulley, and the second feed pulley rotatably mounted on the print engine, the supply spindle, the rewind spindle, the feed roller, and the second feed roller rotatably mounted on the ribbon cassette, the supply spindle coupled to the supply pulley, the rewind spindle coupled to the rewind pulley, the feed roller coupled to the feed pulley, and the second feed roller coupled to the second feed pulley when the print cassette is coupled to the print engine.

12. A thermal printer for transferring print from a ribbon onto a web, comprising:

a supply spindle;

a rewind spindle, the ribbon wound partially about the supply spindle and the rewind spindle;

a feed roller, the ribbon disposed at least partially about and frictionally engaged with the feed roller;

a bi-directional motor coupled to the feed roller, the bi-directional motor rotates the feed roller in first and second opposing directions; and a pivotal dancer arm having a dancer roller disposed between the supply spindle and the feed roller, the ribbon disposed at least partially about the dancer roller, the dancer arm biased to maintain tension on the ribbon.

13. The thermal printer of claim 12, the feed roller coupled to the rewind spindle by a drive belt that rotates the rewind spindle, and a drag brake coupled to the supply spindle, the drag brake drags the supply spindle as ribbon is dispensed therefrom.

14. The thermal printer of claim 13, a ribbon cassette removably coupleable to a print engine having the bi-directional motor mounted thereon, the supply spindle, the rewind spindle, and the feed roller rotatably mounted on the ribbon cassette, the feed roller coupled to the bi-directional motor when the ribbon cassette is coupled to the print engine.

15. The thermal printer of claim 14, a thermal print head mounted on the print engine, the thermal print head movable and away from the ribbon, a linear solenoid mounted on the print engine and coupled to the thermal print head, the linear solenoid actuatable to move the thermal print head toward and away from the ribbon.

16. A method for a thermal printer that transfers print from a ribbon onto a moving web, comprising:

dispensing the ribbon from a supply spindle by frictionally engaging the ribbon with a feed roller rotating in a first direction;

winding the ribbon on a rewind spindle when dispensing ribbon from the supply spindle; and reversing the dispensing direction of the ribbon by frictionally engaging the ribbon with the feed roller rotating in a second direction opposite tile first direction; and accelerating the ribbon dispensed from the supply spindle to a speed of the moving web, and transferring ink from the ribbon onto the web when the ribbon speed is substantially the same as the web speed.

17. The method of claim 16, dispensing the ribbon from the rewind spindle and winding the ribbon on the supply spindle when reversing the ribbon dispensing direction.

18. The method of claim 17, rotating the supply spindle, the rewind spindle and the feed roller in first and second opposing directions with a drive belt coupled to a bi-directional motor, dragging the supply spindle when dispensing ribbon therefrom and slipping the rewind spindle when winding ribbon thereon, and dragging the rewind spindle when dispensing ribbon therefrom and slipping the supply spindle when winding ribbon thereon.

19. The method of claim 18, dispensing the ribbon by frictionally engaging the ribbon with a second feed roller rotated by the drive belt coupled to the bi-directional motor.

20. The method of claim 16, moving a thermal print head toward the ribbon when printing on the web, and moving the thermal print head away from the ribbon when not printing on the web.

21. A method for a thermal printer that transfers print from a ribbon onto a moving web, comprising:

dispensing the ribbon from a supply spindle by frictionally engaging the ribbon with a feed roller rotating in a first direction;

winding the ribbon on a rewind spindle when dispensing ribbon from the supple spindle; and reversing the dispensing direction of the ribbon by frictionally engaging the ribbon with the feed roller rotating in a second direction opposite the first direction; and supplying the ribbon from the rewind spindle when reversing the ribbon dispensing direction, and taking up slack in the ribbon with a pivotal dancer arm coupled thereto when reversing the ribbon dispensing direction.

22. The method of claim 21, rotating the rewind spindle with a drive belt coupled to the first feed roller, dragging the supply spindle when dispensing ribbon therefrom, and slipping the rewind spindle when winding ribbon thereon.

* * * * *